US009449545B2

(12) United States Patent
Pyun et al.

(10) Patent No.: US 9,449,545 B2
(45) Date of Patent: Sep. 20, 2016

(54) DISPLAY DEVICE INCLUDING GATE LINE DRIVER AND DRIVING METHOD THEREOF

(71) Applicant: Samsung Display Co., Ltd., Yongin, Gyeonggi-Do (KR)

(72) Inventors: Ki Hyun Pyun, Goyang-si (KR); Yun Mi Kim, Changwon-si (KR); Min Young Park, Busan (KR); Sung-Jun Kim, Cheonan-si (KR); Ju Hyun Kim, Asan-si (KR); Yong Jae Lee, Seoul (KR); Kyung-Hwa Lim, Seoul (KR)

(73) Assignee: Samsung Display Co., Ltd. (KR)

( * ) Notice: Subject to any disclaimer, the term of this patent is extended or adjusted under 35 U.S.C. 154(b) by 228 days.

(21) Appl. No.: 14/161,521

(22) Filed: Jan. 22, 2014

(65) Prior Publication Data

US 2015/0091883 A1 Apr. 2, 2015

(30) Foreign Application Priority Data

Oct. 1, 2013 (KR) ..... 10-2013-0117366

(51) Int. Cl.

*G09G 3/34* (2006.01)
*G09G 3/20* (2006.01)
*G09G 3/36* (2006.01)

(52) U.S. Cl.

CPC ..... *G09G 3/2074* (2013.01); *G09G 3/3614* (2013.01); *G09G 3/3677* (2013.01); *G09G 2310/0289* (2013.01); *G09G 2320/0252* (2013.01)

(58) Field of Classification Search

CPC ..... G09G 2310/0289; G09G 2310/08; G09G 2310/0243; G09G 3/3677
USPC ..... 345/204
See application file for complete search history.

(56) References Cited

U.S. PATENT DOCUMENTS 8,089,447 B2 1/2012 Song et al.
2007/0171168 A1* 7/2007 Park ..... G09G 3/3677 345/92

(Continued)

FOREIGN PATENT DOCUMENTS

KR 1020070039759 A 4/2007
KR 1020080069441 A 7/2008

(Continued)

OTHER PUBLICATIONS

Louis E. Frenzel, Crash Course in Digital Technology, 1998, Buttersworth-Heinemann, 2nd Edition, p. 39.*

*Primary Examiner* — Chanh Nguyen
*Assistant Examiner* — Daniel Duong
(74) *Attorney, Agent, or Firm* — Innovations Counsel LLP

(57) ABSTRACT

A method of reducing a time for switching a gate line driving signal of display device having plural gate lines from a level that is less than a full gate-on level to the gate-on level is disclosed. The method may include: during a gate line pre-charging period of a respective gate line, causing the gate line driving signal to be at the full gate-on level; during a corresponding gate line main-charging period that follows the pre-charging period, causing the gate line driving signal of to be at the full gate-on level; and during an interposed period that is interposed between the gate line pre-charging period and its corresponding gate line main-charging period, causing the gate line driving signal to be at an intermediate level that is between the full gate-on level and an opposed gate-off level.

18 Claims, 9 Drawing Sheets

(56) References Cited

U.S. PATENT DOCUMENTS

| | | | | |
|---|---|---|---|---|
| 2008/0036725 | A1* | 2/2008 | Lee | G09G 3/3677 345/100 |
| 2008/0238906 | A1* | 10/2008 | Kwon | G09G 3/3688 345/208 |
| 2011/0221731 | A1 | 9/2011 | Tae et al. | |
| 2013/0044096 | A1* | 2/2013 | Kim | G09G 3/3677 345/211 |
| 2013/0063186 | A1 | 3/2013 | DeBeer | |
| 2013/0063405 | A1 | 3/2013 | Zhou | |
| 2013/0067290 | A1 | 3/2013 | Tekumalla et al. | |
| 2014/0104248 | A1* | 4/2014 | Won | G09G 5/00 345/204 |

FOREIGN PATENT DOCUMENTS

| | | | |
|---|---|---|---|
| KR | 1020090129558 | A | 12/2009 |
| KR | 1020100048420 | A | 5/2010 |
| KR | 10200100048420 | A | 5/2010 |
| KR | 1020110075413 | A | 7/2011 |

* cited by examiner

DISPLAY DEVICE INCLUDING GATE LINE DRIVER AND DRIVING METHOD THEREOF

CROSS-REFERENCE TO RELATED APPLICATION

This application claims priority to and the benefit of Korean Patent Application No. 10-2013-0117366 filed in the Korean Intellectual Property Office on Oct. 1, 2013, the entire contents of which application are incorporated herein by reference.

BACKGROUND (a) Technical Field

The present disclosure of invention relates to a display device and a driving method thereof, and more particularly, to a display device and a driving method thereof that may increase a charging rate.

(b) Description of the Related Technology

A display device, such as a liquid crystal display (LCD) and an organic light emitting diode (OLED) device, generally includes a display panel including a plurality of pixels and a plurality of signal lines and one or more drivers configured to electrically drive the display panel.

Each pixel includes a switching element connected to a signal providing line, a pixel electrode connected to the switching element, and a counter electrode or counter electrode portion opposing the pixel electrode. The switching element may be one such as a thin film transistor (TFT) which receives a data voltage by way of the signal providing line. The counter electrode may be formed over a whole surface of the display panel and may be applied with a common voltage Vcom. The pixel electrode and the counter electrode may be positioned on a same substrate and/or they may be positioned on different substrates.

The display device receives an input image signal from an external graphic controller. The input image signal contains luminance information for controlling each pixel and the desired luminance for each pixel has a respective and predetermined grayscale value. Each pixel is then driven with a data voltage corresponding to the desired luminance. A data voltage applied to a pixel appears as a driving electric field or current based on a difference with a common voltage applied to a common electrode. Each pixel displays a luminance at which a gray of an image signal appears, based on the pixel voltage. Here, to prevent a degradation phenomenon from occurring when an electric field of a single direction or a current having an identical polarity is applied for too long a time, it is possible to reverse a polarity of a data voltage with respect to a reference voltage for each frame, for each row, for each column, or for each pixel. The corresponding techniques are sometimes referred to as row inversion, column inversion, and dot inversion.

One of the drivers of the display device is a gate lines driver configured to supply gate signals to gate lines of the display panel. Another of the drivers is a data lines driver configured to supply data signals to corresponding data lines of the display panel. The display device typically also has a signal controller configured to control the data lines driver and the gate lines driver, and optionally other modules (e.g., backlighting unit) of the display device.

The gate lines driver may include a shift register including a plurality of stages subordinately connected to each other, or at least one gate line driving circuit. The gate lines driver receives a plurality of driving voltages and a plurality of gate control signals to generate its corresponding gate signals.

The plurality of driving voltages may include a gate-on voltage (Von) capable of turning on a switching element and a gate-off voltage (Voff) capable of turning off the switching element. The plurality of gate control signals may include a scanning start signal STV for instructing a start of scanning, a gate clock signal CPV for controlling a timing for outputting each gate-on pulse, and the like. The gate lines driver sequentially outputs gate-on pulses of respective gate signals sequentially to corresponding ones of the gate lines.

Every time a gate-on pulse is supplied to a corresponding gate line, the data lines driver supplies a corresponding set of data voltages to respective ones of the data lines such that the supplied data voltages may be applied to respective ones of the activated pixels through their respective switching elements.

Currently, a high quality image may be provided according to an increase in a resolution of a display device and thus, there is a trend that the resolution of the display device is increasing. Accordingly, an amount of time for supplying (e.g., charging) each pixel with a corresponding input data voltage may be decreased according to the increase in resolution because there are more rows of pixels to be driven per frame period when the vertical resolution of the display is increased. In particular, when reversing of polarity of the supplied data voltages is involved, an amount of time for charging a respective data voltage into a corresponding pixel so as to reach the desired positive or negative target data voltage may be insufficient.

A pre-charging driving method has been generally used to improve charging time. The pre-charging driving method may transfer a pre-charging voltage by way of a corresponding data line and in advance before applying the desired target data voltage to the corresponding pixel to thereby more quickly reach the positive or negative target pixel voltage for thereby producing a target luminance when performing a main charging of the corresponding pixel. However, transmitting pre-charge levels along the data lines can consume part of the signal bandwidth capability of the data lines, switching between the pre-charge levels and the target levels of the image can consume part of the signal bandwidth capability, and the data lines are at the same time loaded by parasitic capacitances of the pixels operatively coupled thereto.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

As display panels are manufactured to be larger and larger, and have more pixel rows needing refreshing during successive frames, an excessive delay may occur in switching the states of signal lines of the display device, particularly, the states of gate signals that are transmitted along respective gate lines of the enlarged display devices. As a result, an amount of time available for each gate line driving signal to reach a gate-on voltage and an amount of time available for the gate signal to be dropped down to a gate-off voltage may shrink. Accordingly, when charging a corresponding pixel with a target data voltage, pixel charging may start without reaching a full gate-on voltage due to slowness of transitioning of the gate line driving signals along the long gate lines. Accordingly, a pixel charging rate may be deteriorated and the pixel may not exhibit a desired target luminance.

The present disclosure of invention provides a display device and a driving method thereof that may decrease an occurrence of a perceived image stain due to lack of full charging and may improve the display quality by improving a charging rate of the pixels.

More specifically, a method of reducing a time for switching a gate line driving signal of display device having a relatively large number of plural gate lines from a level that is less than a full gate-on level to the gate-on level is disclosed. The method may include: during a gate line pre-charging period of a respective gate line, causing the gate line driving signal to be at the full gate-on level; during a corresponding gate line main-charging period that follows the pre-charging period, causing the gate line driving signal of to be at the full gate-on level; and during an interposed period that is interposed between the gate line pre-charging period and its corresponding gate line main-charging period, causing the gate line driving signal to be at an intermediate level that is between the full gate-on level and an opposed gate-off level An exemplary embodiment in accordance with the present disclosure provides a driving method of a display device including a display panel including a plurality of gate lines and a gate lines driver configured to output a gate signal to the plurality of gate lines, the method including: receiving, by the gate lines driver, a gate clock signal and an output enable signal having a first level and a second level; outputting, by the gate lines driver, a first gate line driving voltage or a second gate line driving voltage different from the first gate line driving voltage when the output enable signal is the first level; and outputting, by the gate lines driver, a third gate line driving voltage (Va) between the first voltage and the second voltage when the output enable signal is the second level.

The first voltage (first gate line driving voltage) may include a gate-on voltage, and the second voltage (second gate line driving voltage) may include a gate-off voltage.

The third voltage (third gate line driving voltage) may be an average voltage of the gate-on voltage and the gate-off voltage.

A level shifter included in the gate lines driver may include a first transistor and a second transistor that are controlled by a first control signal, and a third transistor that is controlled by a second control signal separate from the first control signal. The first control signal may be synchronized with the gate clock signal, and the second control signal may be synchronized with the output enable signal.

The first transistor may be connected between the gate-on voltage and an output terminal of a gate voltage, and the second transistor may be connected between the gate-off voltage and the output terminal.

A channel type of the first transistor may be opposite to a channel type of the second transistor, and a channel type of the third transistor may be identical to the channel type of the second transistor.

The third transistor may be connected between the output terminal and the gate-off voltage.

The channel type of the first transistor may be opposite to the channel type of the second transistor, and the channel type of the third transistor may be identical to the channel type of the first transistor.

The third transistor may be connected between the output terminal and the gate-on voltage.

The outputting of the first voltage or the second voltage when the output enable signal is the first level may include outputting the gate-on voltage during a pre-charging period immediately before a period when the output enable signal is the second level and during a main charging period immediately after the period when the output enable signal is the second level.

Another exemplary embodiment in accordance with the present disclosure of invention also provides a display device including: a display panel including a plurality of gate lines; and a gate lines driver configured to receive a gate clock signal and an output enable signal having a first level and a second level, and to output a gate signal to the plurality of gate lines. The gate lines driver includes a level shifter configured to output a first voltage or a second voltage different from the first voltage when the output enable signal is the first level, and to output a third voltage having a level between the first voltage and the second voltage when the output enable signal is the second level.

The first voltage may include a gate-on voltage, and the second voltage may include a gate-off voltage.

The third voltage may be an average voltage of the gate-on voltage and the gate-off voltage.

The level shifter may include a first transistor and a second transistor that are controlled by a first control signal, and a third transistor that is controlled by a second control signal separate from the first control signal. The first control signal may be synchronized with the gate clock signal, and the second control signal may be synchronized with the output enable signal. The first transistor may be connected between the gate-on voltage and an output terminal of a gate voltage, and the second transistor may be connected between the gate-off voltage and the output terminal.

A channel type of the first transistor may be opposite to a channel type of the second transistor, a channel type of the third transistor may be identical to the channel type of the second transistor, and the third transistor may be connected between the output terminal and the gate-off voltage.

The channel type of the first transistor may be opposite to the channel type of the second transistor, a channel type of the third transistor may be identical to the channel type of the first transistor, and the third transistor may be connected between the output terminal and the gate-on voltage.

The gate lines driver may output the gate-on voltage during a pre-charging period immediately before a period when the output enable signal is the second level and a main charging period immediately after the period when the output enable signal is the second level.

The display panel may further include a first data line and a second data line extended in a first direction and adjacent to each other and a plurality of pixels connected to the first and second data lines and the plurality of gate lines. A plurality of pixels arranged in the first direction may be alternately connected to the first and second data lines.

According to an exemplary embodiment of the present invention, it is possible to decrease an occurrence of a stain due to a low charging rate and improve the display quality by improving a charging rate of a pixel.

DETAILED DESCRIPTION

The present disclosure of invention will be described more fully hereinafter with reference to the accompanying drawings, in which exemplary embodiments thereof are shown. As those skilled in the art would realize in view of the present disclosure, the described embodiments may be modified in various different ways, all without departing from the spirit or scope of the present teachings.

Throughout this specification and including the claims, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not to the exclusion of adding on other elements.

Hereinafter, a display device and a driving method thereof according to an exemplary embodiment of the present disclosure of invention will be described in detail with reference to the accompanying drawings.

Initially, a display device according to an exemplary embodiment of the present disclosure will be described with reference to FIGS. 1 through 4.

Figure 1:
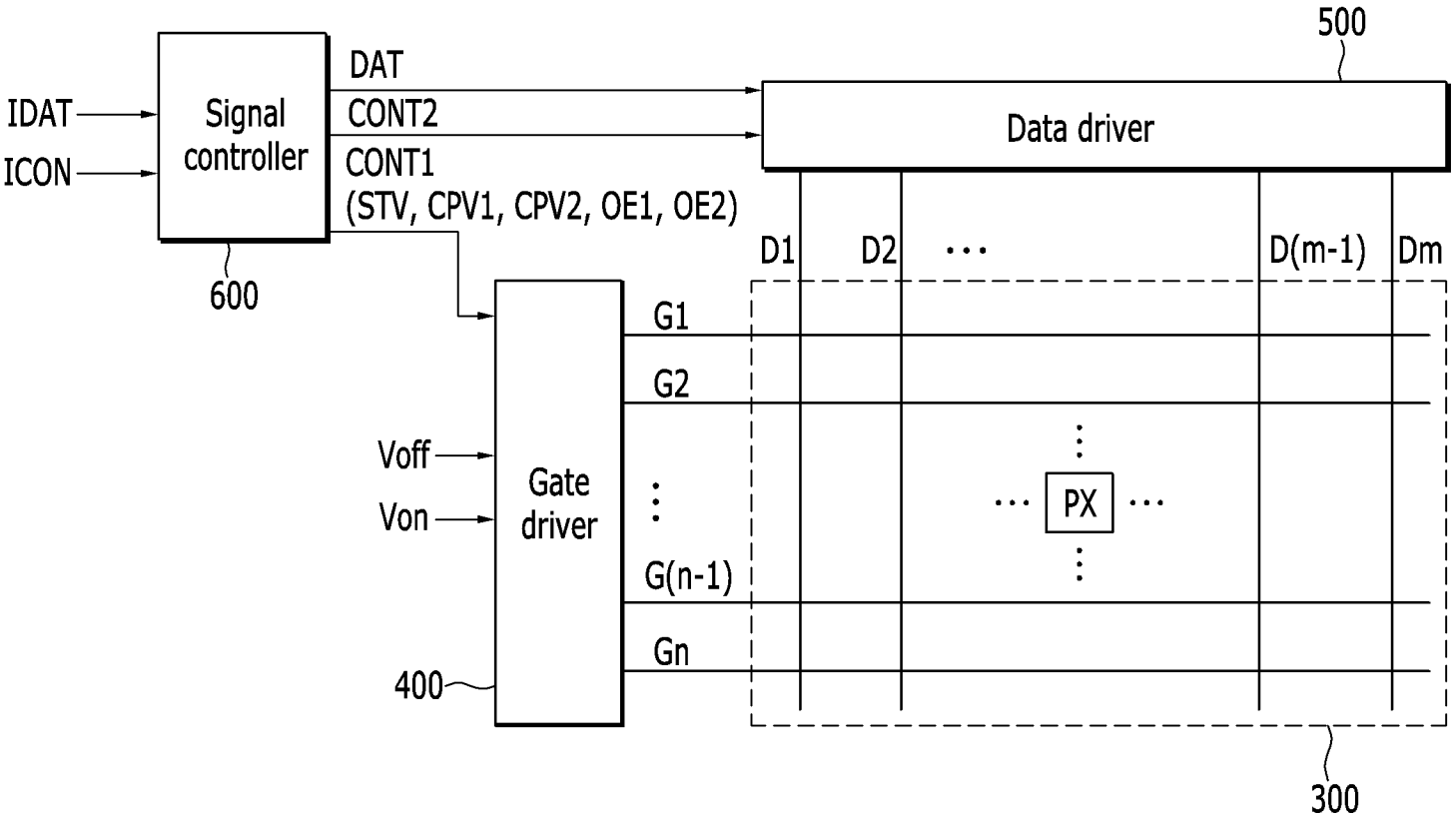
FIG. 1 is a block diagram of a display device according to an exemplary embodiment of the present disclosure of invention.
Figure 2:
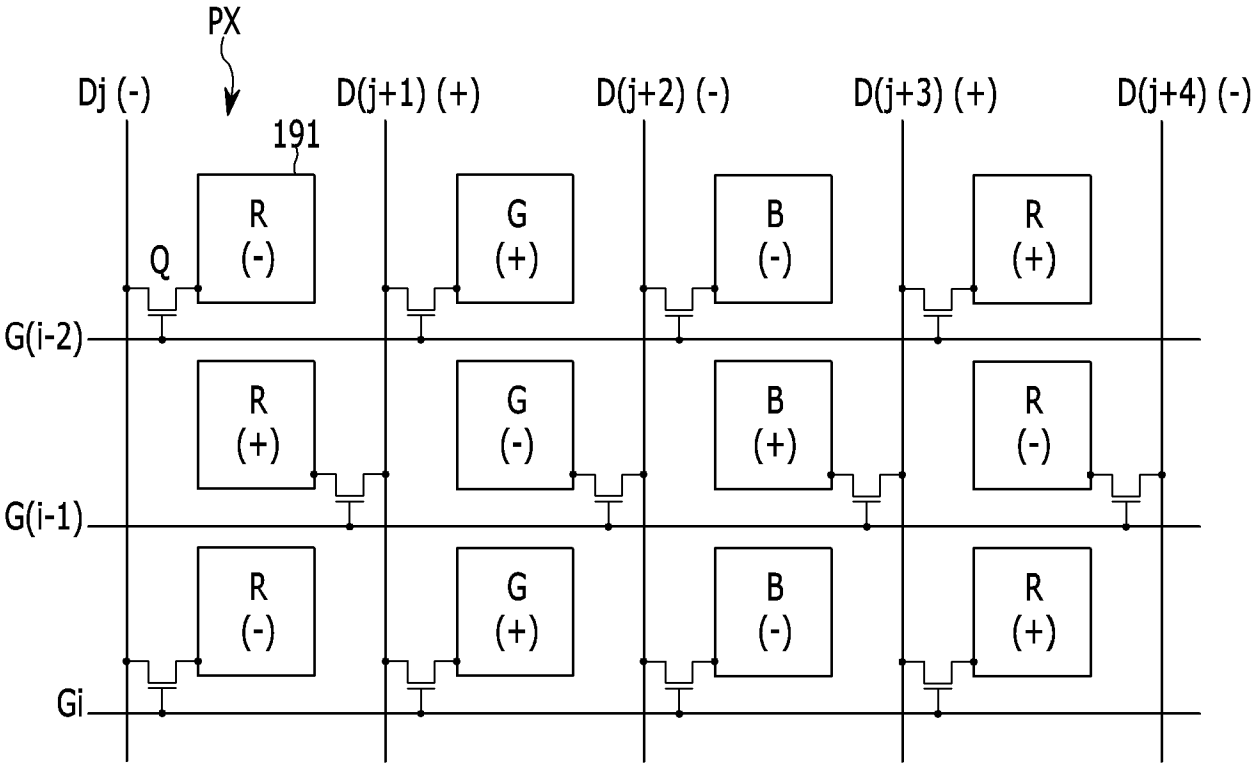
FIG. 2 is a layout view of a matrix of pixels and signal lines of a display device in a case where dot inversion is desired.
Figure 3:
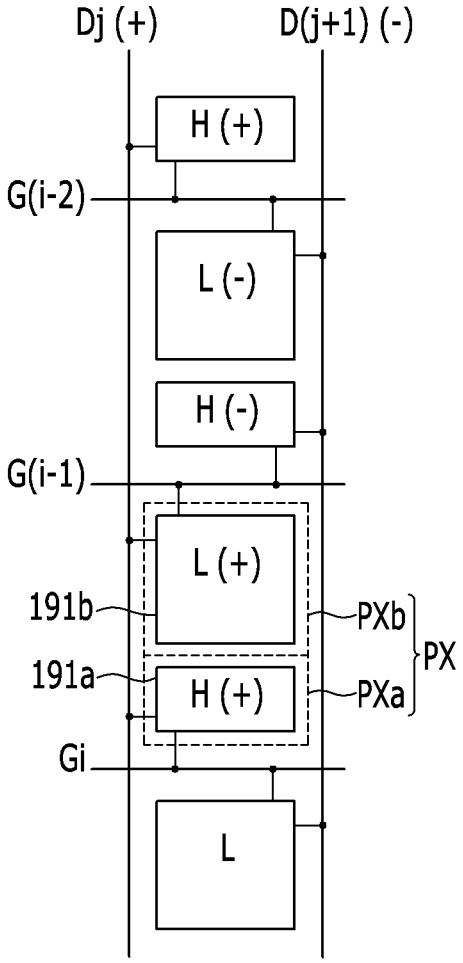
FIG. 3 is a layout view of a pixel and a signal line of a display device according to an exemplary embodiment of the present disclosure wherein each pixel PX has plural subpixels.
Figure 4:
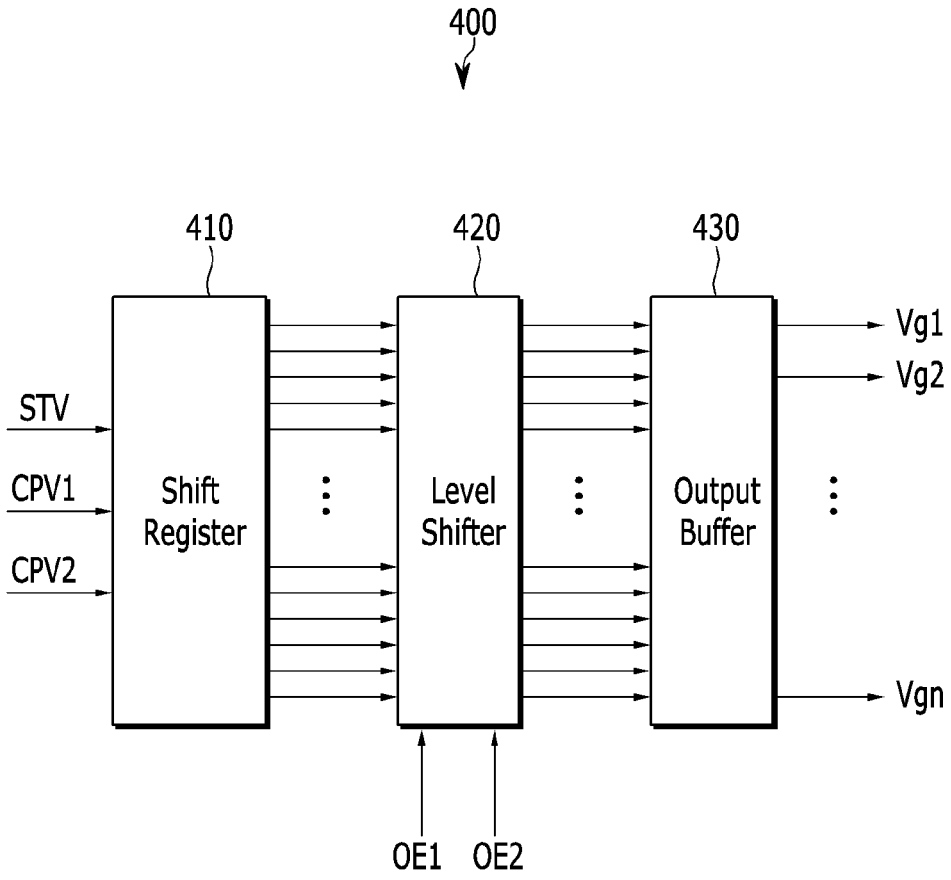
FIG. 4 is a block diagram of a gate lines driver according to an exemplary embodiment of the present disclosure wherein a level shifter is employed.
Figure 5:
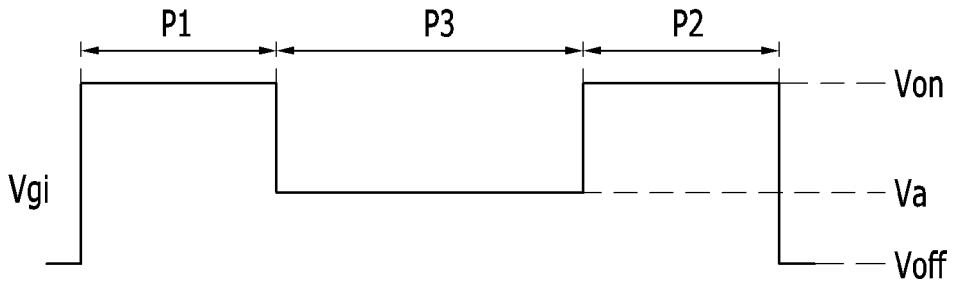
FIG. 5 is a waveform timing diagram illustrating a gate signal used in a display device according to an exemplary embodiment of the present disclosure.

FIG. 1 is a block diagram of a display device according to an exemplary embodiment. FIG. 2 is a layout view of pixels and signal lines of the display device according to the first exemplary embodiment. FIG. 3 is a layout view of pixels and corresponding signal lines of a display device that uses subpixels, for example to enhance viewing angle. FIG. 4 is a block diagram of a gate lines driver according to an exemplary embodiment of the present disclosure which includes a level shifter. FIG. 5 is a waveform diagram of a gate signal produced by a display device according to the first exemplary embodiment.

Referring to FIG. 1, a display device according to an exemplary embodiment of the present disclosure includes a display panel 300, a gate lines driver 400 and a data lines driver 500 connected to the display panel 300, and a signal controller 600 configured to control the same.

In view of an equivalent circuit, the display panel 300 includes a plurality of signal lines and a plurality of pixels PX connected thereto and arranged in the form of a crossed lines matrix.

The plurality of signal lines includes a plurality of gate lines G1-Gn configured to transfer respective gate signals (also referred to as a "scanning signals") along respective rows and a plurality of data lines D1-Dm configured to transfer respective data voltages along respective columns. The plurality of gate lines G1-Gn are arranged as spaced apart and in parallel with each other and may, as shown, be extended generally in a row direction. The plurality of data lines D1-Dm are arranged as spaced apart and in parallel with each other and may be extended generally in a column direction.

Referring to FIG. 2 and/or FIG. 3, each pixel PX according to an exemplary embodiment includes at least one switching element Q connected to a corresponding at least one of data lines D1-Dm and to a corresponding at least one of gate lines G1-Gn where the at least one switching element Q has a corresponding at least one pixel electrode 191 connected thereto. The switching element Q may be a thin film transistor (TFT), and may be controlled by a gate signal transferred by way of a respective one of gate lines G1-Gn to thereby cause transfer, to the corresponding pixel electrode 191, of a data voltage Vd transmitted along a corresponding one of the data lines D1-Dm. It is to be appreciated that the signal levels on the respective data lines D1-Dm vary over time and thus each data line may be considered as an analog signal transmission line carrying an over-time, modulated signal where the line is loaded by the pixels operatively coupled thereto.

An example of a structure of plural pixels PX and their respective signal lines in the display panel 300 according to an exemplary embodiment will be described with reference to FIG. 2. Here, polarity inversion is assumed to be employed at least horizontal along each row of pixels. Accordingly, each data line is transmitting a respective data signal that repeatedly modulates between positive and negative (as measured relative to an in between reference level) as a −+−+ . . . pattern along a row is switched to a +−+− . . . pattern and then vice versa over time.

More specifically, the illustrated display panel 300 includes a plurality of gate lines Gi, G(i+1), . . . generally extended in a row direction, a plurality of data lines Dj, D(j+1), . . . generally extended in a column direction, and a plurality of pixels PX. Each pixel PX may include a corresponding at least one pixel electrode 191 connected to a respective gate line Gi, G(i+1), . . . and selectively coupled to a respective data lines Dj, D(j+1), . . . through a switching element Q when that switching element Q is turned on. Each pixel PX is illustrated to represent one of primary colors including red R, green G, and blue B in the present exemplary embodiment, but is not limited thereto.

Each pixel column may include pixels representing a corresponding one of the primary colors R, G, and B. For example, a first pixel column of red pixels R, a second pixel column of green pixels G, and a third pixel column of blue pixels B may be alternately disposed as shown. In FIG. 2, a pixel PX representing any one primary color among R, G, and B is expressed using a reference numeral identical to the corresponding primary color R, G, or B. The data lines Dj, D(j+1), . . . may be disposed one by one per each pixel column and the gate lines Gi, G(i+1), . . . may be disposed one by one per each pixel column, but are not limited thereto.

Pixels R, G, or B disposed in a pixel column to represent an identical primary color may be connected to any one of two adjacent data lines Dj, D(j+1), . . . . More specifically, as illustrated in FIG. 2, pixels R, G, or B disposed in a pixel column may be alternately connected to two data lines Dj, D(j+1), . . . adjacent to the pixel column. Pixels R, G, or B positioned in a pixel row may be connected to the same gate line Gi, G(i+1), . . . . Adjacent data lines Dj, D j+1, . . . may transfer data voltages having different polarities. This configuration allows each data line to keep a same polarity either positive (+) or negative (−) throughout a frame period whereby the degree of modulation along each data line is reduced as compared to an alternate case (not shown) where each data line has to repeatedly switch polarity during each frame period.

Another example of a structure of a pixel PX and a signal line in the display panel 300 according to an exemplary embodiment of the present disclosure will be described with reference to FIG. 3.

The display panel 300 includes a plurality of gate lines . . . , G(i−2), G(i−1), Gi, . . . generally extended in a row direction, a plurality of data lines Dj, D(j+1), . . . generally extended in a column direction, and a plurality of pixels PX.

Each pixel PX may include a plurality of subpixels PXa and PXb capable of expressing different luminance with respect to an identical input image signal. In the present exemplary embodiment, the luminance of a first subpixel PXa may be higher than or equal to the luminance of a second subpixel PXb. In this case, an area of the first subpixel PXa may be smaller than an area of the second subpixel PXb. In FIG. 3, the first subpixel PXa of which the luminance may be relatively high is expressed as "H" and the second subpixel PXb of which the luminance may be relatively low is expressed as "L".

The first subpixel PXa includes a first subpixel electrode 191*a*, and the second subpixel PXb includes a second subpixel electrode 191*b*. At least one of the first subpixel electrode 191*a* and the second subpixel electrode 191*b* is connected to a gate line . . . , G(i−2), G(i−1), Gi, . . . and a data line Dj, D(j+1), . . . through a switching element (not shown). FIG. 3 illustrates an example in which each of the first subpixel electrode 191*a* and the second subpixel electrode 191*b* is connected to a gate lines . . . , G(i−2), G(i−1), Gi, . . . and a data line Dj, D(j+1), . . . through a switching element.

The first subpixel PXa and the second subpixel PXb of a single pixel PX may be connected to different gate lines . . . , G(i−2), G(i−1), Gi, . . . and an identical data line Dj, D(j+1), . . . to thereby be applied with different data voltages. Dissimilar thereto, the first subpixel PXa and the second subpixel PXb of a single pixel PX may be connected to different data lines Dj, D(j+1), . . . and an identical gate line . . . , G(i−2), G(i−1), Gi, . . . . In the exemplary embodiment of FIG. 3, the first and second subpixels PXa and PXb of a single pixel PX are connected to an identical data line Dj, D(j+1), . . . and thus, may be applied with a data voltage having an identical polarity during a single frame.

In the case of the display device according to the exemplary embodiment of FIG. 2 or FIG. 3, data voltages having opposite polarities may be applied to adjacent data lines Dj, D(j+1), . . . . Accordingly, adjacent pixels in a column direction may be applied with data voltages having opposite polarities, and adjacent pixels in a pixel row may be applied with data voltages having opposite polarities and thus, may be driven in an approximate 1×1 dot inversion format. That is, even though a data voltage applied to a data line Dj, D(j+1), . . . maintains an identical polarity during a single frame, it is possible to display an image driven in accordance with a dot inversion format.

Each pixel PX may display one of primary colors (spatial division) or alternately display primary colors over time (temporal division) in order to embody full gamut color display, thereby enabling a desired color to be recognized as a spatial or temporal summation of these primary colors. Examples of primary colors may be three primary colors such as red, green, and blue, three primary colors such as yellow, cyan, and magenta, or four colors (e.g., RGBW, W being white). A plurality of adjacent or discrete pixels PX configured to represent different primary colors may constitute a single set (referred to as a dot). A single dot may be driven so as to display a white image.

Referring again to FIG. 1, the signal controller 600 receives an input image signal IDAT and an input control signal ICON from a graphic controller (not shown) to control an operation of the gate lines driver 400 and the data lines driver 500.

The input image signal IDAT may contain luminance information of each pixel PX. The luminance has a predetermined number, for example, $1024=2^{10}$, $256=2^{8}$, or $64=2^{6}$ of grays. The input image signal IDAT may be present for each primary color represented by a pixel PX. Examples of the input control signal ICON may include a vertical synchronization signal, a horizontal synchronizing signal, a main clock signal, a data enable signal, and the like.

The signal controller 600 converts the input image signal IDAT to an output image signal DAT by processing the input image signal IDAT based on the input image signal IDAT and the input control signal ICON, and generates a gate control signal CONT1, a data control signal CONT2, and the like.

The gate control signal CONT1 includes a scanning start signal STV for instructing a start of scanning, at least one of gate clock signals CPV1 and CPV2, and the like. The gate control signal CONT1 may also further include at least one of output enable signals OE1 and OE2 for limiting a continuance time or a timing of a predetermined voltage of a gate signal.

The data control signal CONT2 includes a horizontal synchronization start signal STH) for informing a start of a transmission of the output image signal DAT with respect to a pixel PX of a single row, a data load signal TP for applying a data voltage Vd to a data line D1-Dm, a data clock signal HCLK, and the like. The data control signal CONT2 may also further include an inversion control signal RVS for selectively reversing a polarity of the data voltage Vd with respect to a common voltage Vcom.

The data driver 500 is connected to data lines D1-Dm, selects a gray voltage based on the output image signal DAT received from the signal controller 600, and applies the gray voltage to the data lines D1-Dm as a data voltage Vd. The data driver 500 may also receive a gray voltage generated by a separate gray voltage generator (not shown), and may also be provided with and may be partially urged by only a limited number of reference gray voltages which are then extrapolated between to thereby generate the entire array of grays.

The gate lines driver 400 is connected to gate lines G1-Gn and applies a gate signal including a plurality of gate voltages to the gate lines G1-Gn. The plurality of gate voltages each includes a gate-on voltage level, Von and a gate-off voltage level Voff, and in accordance with the present disclosure further includes a predetermined intermediate voltage Va different from and between the levels the gate-on voltage and the gate-off voltage. When the intermediate voltage Va is applied, the corresponding transistor (TFT) enters a resistive state in which it is neither fully turned on (e.g., saturated) or fully turned off (e.g., deep below threshold) and from which it can quickly return to the fully turned on state.

Referring to FIG. 4, the gate lines driver 400 according to an exemplary embodiment includes a shift register 410, a level shifter 420, and an output buffer 430.

The shift register 410 includes a plurality of stages sequentially connected to each other. The shift register 410 may receive a scanning start signal STV and at least one of gate clock signals CPV1 and CPV2 from the signal controller 600. The plurality of stages may be synchronized with one or both of the gate clock signals CPV1 and CPV2 to thereby sequentially transfer a carry signal to an adjacent stage. Each stage sequentially generates a gate line activate-indicating output voltage and then outputs that output voltage to the level shifter 420.

The level shifter 420 amplifies a level of the gate line activate-indicating output voltage received from the shift register 410 to be a level suitable for operating a switching element included in a pixel PX of the display panel 300, and outputs the amplified output voltage to the output buffer 430. The level shifter 420 receives output enable signals OE1 and OE2 from the signal controller 600, and may limit a continuance time or a timing of a predetermined voltage included in the output voltage, based on the output enable signal OE1 and OE2. A description relating thereto will be made in detail below.

The output buffer 430 buffers the amplified output voltage produced by the level shifter 420, and outputs the buffered output voltage to the gate lines G1-Gn as respective ones of gate signals Vg1-Vgn.

Referring to FIG. 5, each produced gate signal Vgi (i= 1, . . . , n) output from the gate lines driver 400 includes a low voltage period and a high voltage period. The low voltage period includes a gate-off voltage level Voff. By contrast, the high voltage period includes a pre-charging period P1, a temporally spaced apart main charging period P2, and an interposed and intermediate mode-switching period P3 positioned between the pre-charging period P1 and the main charging period P2. The gate signal Vgi has a level of the gate-on voltage Von in the pre-charging period P1 and in the main charging period P2. By contrast, the gate signal Vgi has a level of a predetermined and intermediate voltage Va having a value disposed between that of the gate-on voltage Von and that of the gate-off voltage Voff in the intermediate period P3. The predetermined voltage Va may be an approximate average voltage of the gate-on voltage Von and the gate-off voltage Voff. In one embodiment, the predetermined voltage Va is selected such that, when the intermediate voltage Va is applied to its gate, the corresponding transistor (TFT) enters a resistive state in which it is neither fully turned on (e.g., saturated) or fully turned off (e.g., deep below threshold) and from which resistive state it can quickly return to the fully turned on state (e.g., a saturated state).

The intermediate period P3 is synchronized to correspond with a pulse width of a respective one of output enable signals OE1 and OE2. (See for example OE1 and Vg1 in FIG. 6.)

Each gate lines and/or data lines driving device may be directly mounted on or otherwise coupled to the display panel 300 in the respective form of at least one of an IC chip, where the latter may be mounted on a flexible printed circuit board (not shown) to thereby be attached to the display panel 300 by way of a flexible tape carrier package TCP, or it may also be mounted on a separate PCB (not shown). Dissimilar thereto, the respective driving device may be monolithically integrated on the display panel 300 together with signal lines G1-Gn and D1-Dm, the in-pixel thin film transistors, and the like.

An example of a driving method of the display device will be described with reference to FIG. 6 together with FIGS. 1 through 5.

Figure 6:
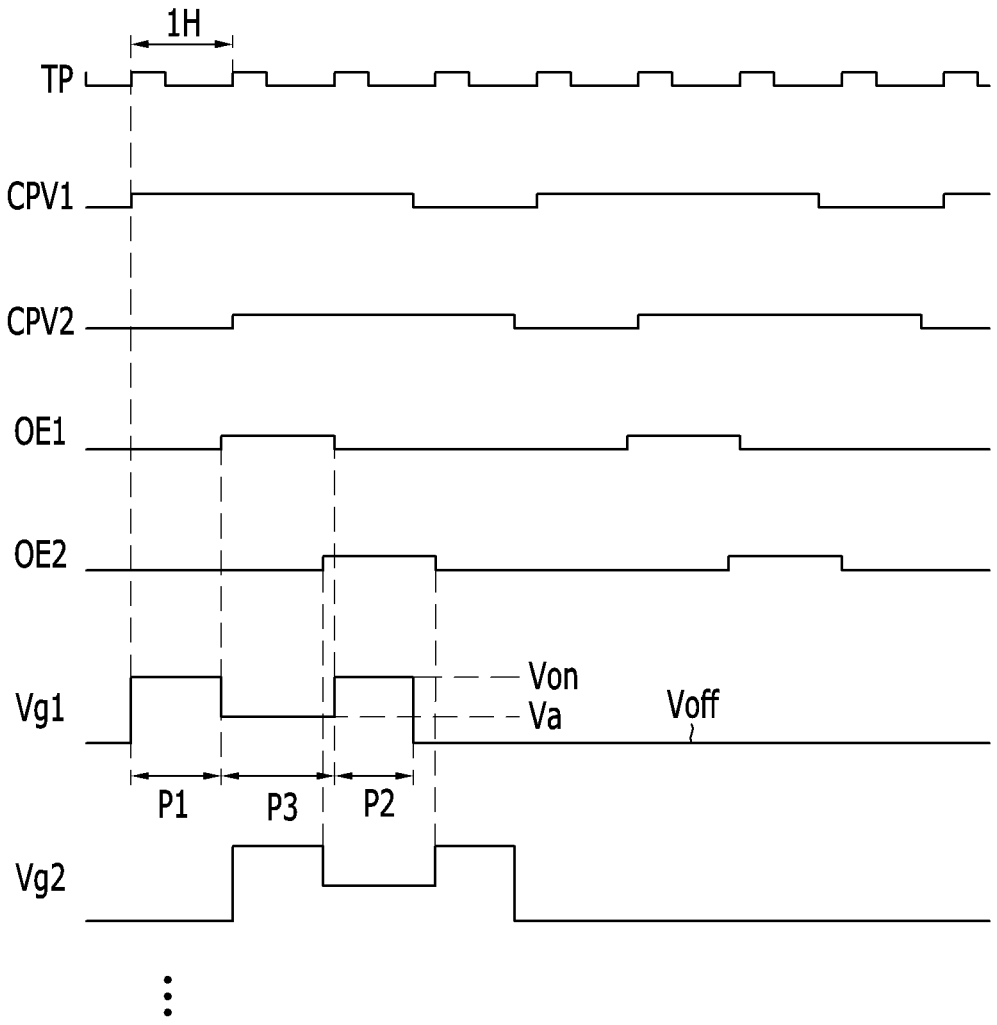
FIG. 6 is a multi-waveforms timing diagram showing a plurality of driving signals and their temporal correlation in a display device according to an exemplary embodiment.

FIG. 6 is a timing diagram of a plurality of temporally aligned driving signals in a display device according to an exemplary embodiment of the present disclosure.

The signal controller 600 receives, from an external graphic controller (not shown), an input image signal IDAT and an input control signal ICON for controlling displaying thereof.

The signal controller 600 processes the input image signal IDAT to be suitable for an operating condition of the display panel 300 based on the input image signal IDAT and the input control signal ICON, and generates a gate control signal CONT1, a data control signal CONT2, and the like. The signal controller 600 transmits the gate control signal CONT1 to the gate lines driver 400 and transmits the data control signal CONT2 and the processed output image signal DAT to the data lines driver 500. A load data signal TP included in the data control signal CONT2 includes a periodic pulse having a 1 horizontal row scan period 1H as its period.

The data lines driver 500 receives the output image signal DAT with respect to pixels PX of a single row based on the data control signal CONT2 from the signal controller 600 and selects a gray voltage corresponding to each output image signal DAT and accordingly, converts the output image signal DAT corresponding to a digital signal to the data voltage Vd corresponding to an analog data signal and then applies the data voltage Vd to a corresponding one of data lines D1-Dm.

The gate lines driver 400 receives the gate control signal CONT1 from the signal controller 600 and generates the respective gate signals Vg1-Vgn which each include a plurality of different gate drive voltages. The gate control signal CONT1 includes at least one gate clock signal CPV1 and CPV2 and at least one output enable signal OE1 and OE2. In the present exemplary embodiment, two gate clock signals CPV1 and CPV2 and two output enable signals OE1 and OE2 are used as an example.

The plurality of gate clock signals CPV1 and CPV2 may have different phases, and a phase difference between adjacent gate clock signals CPV1 and CPV2 may be about 1H. Although not illustrated, the gate control signal CONT1 according to the exemplary embodiment of FIG. 6 may further include a third gate clock signal having a phase different from phases of two gate clock signals CPV1 and CPV2. A phase difference between a gate clock signal having a relatively late phase between the two gate clock signals CPV1 and CPV2 and the third gate clock signal may be about 1H.

Each of the plurality of output enable signals OE1 and OE2 includes a pulse timed to correspond with, for example the rising edge of a pulse of a corresponding one of gate clock signals CPV1 and CPV2 or a delayed version of that rising edge. For example, the first output enable signal OE1 may include periodic pulses corresponding to midpoints of the respective pulses of the first gate clock signal CPV1, and the second output enable signal OE2 may include periodic pulses corresponding to midpoints of the respective pulses of the second gate clock signal CPV2. More specifically, here, the pulse of each output enable signal OE1 and OE2 may be delayed so as to correspond to an approximate middle portion of the pulse of the corresponding gate clock signal CPV1 and CPV2. A pulse width of each output enable signal OE1 and OE2 may be smaller than a pulse width of the corresponding gate clock signal CPV1 and CPV2 and may be about 1H or more, but is not limited thereto. As described above, when the gate control signal CONT1 further includes the third gate clock signal, a third output enable signal corresponding thereto may be further included.

Referring to FIG. 6, the gate lines driver 400 is synchronized with the gate clock signals CPV1 and CPV2 and sequentially outputs the corresponding gate signals Vg1, Vg2, . . . etc. For example, a first gate signal Vg1 may include a high voltage period synchronized with a first gate clock signal CPV1, and a second gate signal Vg2 followed by the first gate signal Vg1 may include a high voltage period synchronized with a second gate clock signal CPV2.

As illustrated in FIG. 5, a low voltage period of each gate signal Vg1, Vg2, . . . includes a gate-off voltage Voff. Separately, a high voltage period thereof includes a pre-charging period P1, a spaced apart main charging period P2, and an intermediate resistive-mode period P3 positioned between the pre-charging period P1 and the main charging period P2.

In the pre-charging period P1 and also in the main charging period P2, each gate signal Vg1, Vg2, . . . has a level of the full drive, gate-on voltage Von. However, in the intermediate period P3, each gate signal Vg1, Vg2, . . . has a level of a predetermined voltage Va between the gate-on voltage Von and the gate-off voltage Voff. The predetermined voltage Va may be an approximate average voltage of the gate-on voltage Von and the gate-off voltage Voff.

As illustrated in FIG. 6, the intermediate period P3 of each gate signal Vg1, Vg2, . . . is synchronized with the corresponding pulses of the output enable signals OE1 and OE2, and has a width approximately identical to a width of a corresponding pulse of the output enable signal OE1 and OE2. For example, the intermediate period P3 of the first gate signal Vg1 is synchronized with a pulse of a first output enable signal OE1 and has a width approximately identical to a width of the corresponding pulse of the first output enable signal OE1. Also, the intermediate period P3 of the second gate signal Vg2 is synchronized with a pulse of a second output enable signal OE2 and has a width approximately identical to a width of the corresponding pulse of the second output enable signal OE2.

The gate lines driver 400 sequentially applies a gate-on voltage Von of a gate signal Vg1, Vg2, . . . to a gate line G1-Gn and thereby fully turns on a switching element Q connected to the gate line G1-Gn. As a result, a data voltage Vd then applied to a data line D1-Dm is coupled to a corresponding pixel PX through the fully turned-on switching element Q.

In particular, similar to the aforementioned exemplary embodiment of FIG. 2 or FIG. 3, a driving method of the display panel 300 in a case in which an i-th gate line Gi and the (i−2)-th gate line G(i−2) are connected to an identical data line Dj, D(j+1), . . . and the (i−1)-th gate line G(i−1) therebetween is connected to a different data line Dj, D(j+1), . . . will be described in detail.

First, when the gate-on voltage Von of the main charging period P2 is applied to the (i−2)-th gate line G(i−2) and thereby a pixel PX having a switching element (e.g., TFT) connected thereto is mainly charged with a target data voltage, the gate-on voltage Von of the pre-charging period P1 is applied to the i-th gate line Gi. Next, a pixel PX having a switching element (e.g., TFT) connected to the i-th gate line Gi is pre-charged with a data voltage with respect to a pixel PX preceding two rows. Here, a polarity of the pre-charged data voltage may be identical to a polarity of the target data voltage expected 2H periods later.

When the gate-on voltage Von of the main charging period P2 is applied to the (i−1)-th gate line G(i−1) after 1H is elapsed and thereby the pixel PX connected thereto is mainly charged with the target data voltage, the predetermined voltage Va of the intermediate period P3, that is, a voltage of intermediate value (Von−Voff)/2 for example is applied to the i-th gate line Gi. Accordingly, current (Ids) between a source and a drain of a thin film transistor connected to the i-th gate line Gi is relatively small due to the transistor being in an unsaturated resistive mode and charging of the pixel PX connected to the i-th gate line Gi is less than it would be if the full on voltage Von had been applied.

After 1H has elapsed with the TFT in resistive mode, the full gate-on voltage Von of the main charging period P2 is applied to the i-th gate line Gi and thereby the pixel PX connected thereto is mainly charged with the target data voltage. Here, the gate signal Vgi to be applied to the i-th gate line Gi is already elevated to a voltage of an intermediate level (Va) between the gate-on voltage Von and the gate-off voltage Voff, not to the gate-off voltage Voff, immediately before the gate-on voltage Von of the main charging period P2 is applied and thus, it may more quickly reach the gate-on voltage Von in the main charging period P2. Accordingly, in the main charging period P2, the corresponding pixel PX may be sufficiently charged with the target data voltage and thus, a charging rate of the pixel PX may be increased as compared to if the sub-threshold Voff were being applied to the gate.

As described above, a difference between a data voltage applied to a pixel PX and a common voltage Vcom appears as a pixel voltage of the corresponding pixel PX and a luminance of an image may be indicated based on the pixel voltage.

By repeating the above process based on a 1 horizontal period 1H basis, the gate-on voltage Von is sequentially applied to all of the gate lines G1-Gn and the data voltage is applied to all of the pixels PX and accordingly, an image of a single frame is formed (e.g., painted down the screen) and displayed. When a single frame ends, a subsequent frame starts and a state of an inversion signal RVS applied to the data driver 500 may be controlled so that a polarity of the data voltage applied to each pixel PX becomes to be opposite to a polarity of a previous frame ("frame inversion").

Hereinafter, an example of circuitry within the level shifter 420 of the gate lines driver according to an exemplary embodiment of the present invention applicable to the driving method of FIG. 6 will be described with reference to FIGS. 6 and 7.

Figure 7:
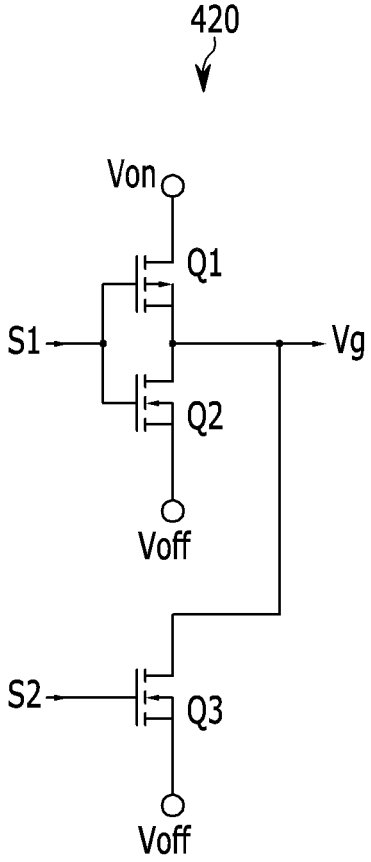
FIG. 7 is an example of a circuit diagram of a level shifter of a gate lines driver according to an exemplary embodiment.

FIG. 7 is an example of a circuit diagram of a level shifter driver of the gate lines driver according to an exemplary embodiment.

Referring to FIG. 7, the level shifter 420 of the gate lines driver 400 according to an exemplary embodiment includes a first transistor Q1 connected between a gate-on voltage Von and an output terminal of a gate voltage Vg, a second transistor Q2 connected between a gate-off voltage Voff and the output terminal, and a third transistor Q3 connected between the gate-off voltage Voff and the output terminal.

The output terminal of the level shifter 420 outputs the gate voltage Vg. The first to third transistors Q1, Q2, and Q3 may be MOSFETs.

A channel type of the second transistor Q2 may be identical to a channel type of the third transistor Q3, and a channel type of the first transistor Q1 may be different from the channel type of the second and third transistors Q2 and Q3. For example, according to the exemplary embodiment of FIG. 7, the channel types of the second transistor Q2 and the third transistor Q3 may be an N type, and the channel type of the first transistor Q1 may be a P type. However, a channel type of a transistor is not limited thereto and channel types of the first to third transistors Q1, Q2, and Q3 may be changed to be opposite to the channel types illustrated in FIG. 7.

The first transistor Q1 and the second transistor Q2 are controlled by an identical first control signal S1, and the third transistor Q3 is controlled by a second control signal S2 separate from the first control signal S1. The first control signal S1 is simultaneously applied to a gate of the first transistor Q1 and a gate of the second transistor Q2, and the second control signal S2 is applied to a gate of the third transistor Q3. The first control signal S1 is a control signal synchronized with an inverse of a respective one of gate clock signals CPV1 and CPV2 (but not necessarily always having a full gate drive level), and the second control signal S2 is a control signal synchronized with an output enable signal OE1 and OE2. For example, in the present exemplary embodiment, the first control signal S1 may have a low voltage when the gate clock signal CPV1 and CPV2 has a high level, and may have a high voltage when the gate clock signal CPV1 and CPV2 has a low level. The second control signal S2 may have a high voltage when the output enable signal OE1 and OE2 has a high level, and may have a low voltage when the output enable signal OE1 and OE2 has a low level. While Q1 and Q3 are of opposite conductivity types (e.g., Q1 being PMOS while Q3 being NMOS), they are not necessarily fabricated to have same effective channel widths and corresponding resistivities (respective $R_{DS}$'s). More specifically, the channel width of Q3 may be substantially smaller than that of Q1 such that when Q1 is turned on to have a respective first RD, the same-time turned on Q3 has a respective second $R_{DS}$, which could be approximately the same as the first $R_{DS}$, where both are relatively high so that a large crowbar current does not flow through the series circuit formed by the simultaneously turned-on Q1 and Q3 and instead a voltage divider network is formed for producing the desired Va level.

Hereinafter, an operation of the level shifter 420 constructed above will be described with reference to FIGS. 6 and 7.

Initially, when the gate clock signal CPV1 and CPV2 reaches a high level in a state in which the output enable signal OE1 and OE2 has a low level, the first transistor Q1 is fully turned on and the second and third transistors Q2 and Q3 are turned off. Accordingly, the gate-on voltage Von is output through the output terminal and a pre-charging period P1 starts. Here, in the exemplary embodiment of FIG. 7, the first control signal S1 and the second control signal S2 may have a low voltage.

Next, when the output enable signal OE1 and OE2 shifts from a low level to a high level while the gate clock signal CPV1 and CPV2 has a high level, the first transistor Q1 is turned on (not necessarily fully) and the second transistor Q2 is turned off. In this state, the third transistor Q3 is turned on and accordingly, an intermediate voltage Va between the gate-on voltage Von and the gate-off voltage Voff, that is, a voltage approximately equal to (Von−Voff)/2 for example is output through the output terminal and the intermediate period P3 starts. Here, the first control signal S1 may have a low voltage and the second control signal S2 may have a high voltage. (It is to be understood that there can be many different ways to cause Q1 to have higher and lower $R_{DS}$ values as desired at different times. One possible way is to construct Q1 as a plurality of in-parallel sub-transistors (e.g., Q1*a*, Q1*b*, . . . Q1*n*) where not all are always turned on and thus the effective channel depends on how many of the in-parallel sub-transistors are turned on.)

Next, when the output enable signal OE1 and OE2 shifts again from a high level to a low level while the gate clock signal CPV1 and CPV2 has a high level, the first transistor Q1 is fully turned on and the second and third transistors Q2 and Q3 are turned off. Accordingly, the gate-on voltage Von is output through the output terminal and the main charging period P2 starts. Here, the first control signal S1 and the second control signal S2 may have appropriate low voltages during the P3 period so as to avoid conduction of large crowbar currents between the Von and Voff voltage rails.

Next, when the gate clock signal CPV1 and CPV2 shifts from a high level to a low level in a state in which the output enable signal OE1 and OE2 has a low level, the first and third transistors Q1 and Q3 are turned off and the second transistor Q2 is turned fully on. Accordingly, the gate-off voltage Voff is output through the output terminal and a high voltage period of the gate signal Vgi ends. Here, the first control signal S1 may have a high voltage and the second control signal S2 may have a low voltage.

Hereinafter, an example of a driving method of a display device according to an exemplary embodiment of the present disclosure will be described with reference to FIGS. 1 through 8.

Figure 8:
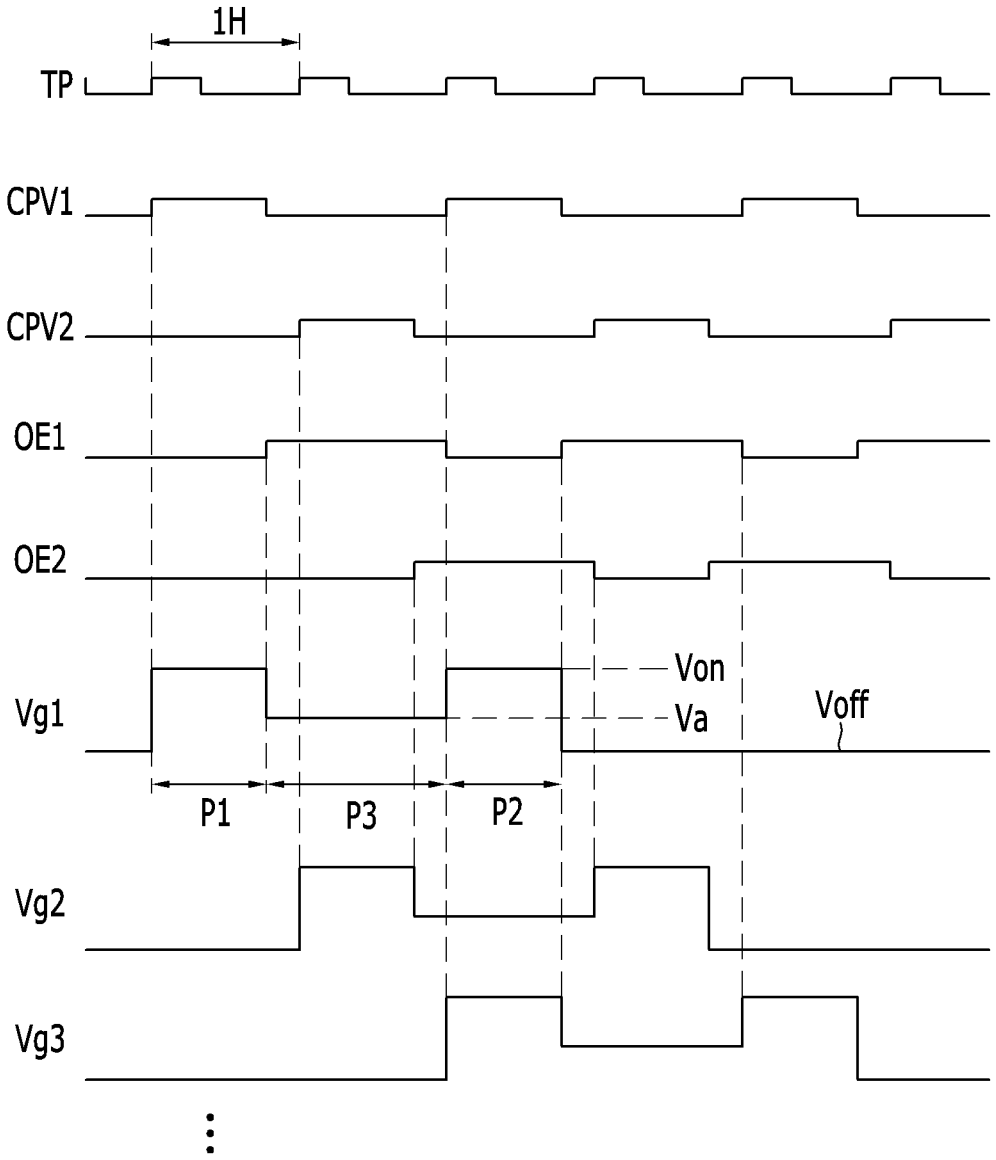
FIG. 8 is a multi-waveforms timing diagram showing a plurality of driving signals in a display device according to an exemplary embodiment.

FIG. 8 is a timing diagram of a plurality of driving signals in a display device according to an exemplary embodiment of the present disclosure of invention.

The driving method of the display device according to the present exemplary embodiment is mostly similar to the aforementioned driving method according to the waveform of the driving signal of FIG. 6 and thus, a description will be made based on additional details.

The signal controller 600 receives an input image signal IDAT and an input control signal ICON, and generates a gate control signal CONT1, a data control signal CONT2, an output image signal DAT, and the like, based on the input image signal IDAT and the input control signal ICON.

The data driver 500 selects a gray voltage corresponding to each output image signal DAT based on the data control signal CONT2 from the signal controller 600, converts the output image signal DAT to a data voltage Vd and then applies the converted data voltage Vd to a corresponding data line D1-Dm.

The gate lines driver 400 receives the gate control signal CONT1 from the signal controller 600, and generates a gate signal Vg1-Vgn. The gate control signal CONT1 includes a plurality of gate clock signals CPV1 and CPV2 and a plurality of output enable signals OE1 and OE2.

The plurality of gate clock signals CPV1 and CPV2 may have different phases, and a phase difference between adjacent gate clock signals CPV1 and CPV2 may be about 1H. A period of a pulse of each gate clock signal CPV1 and CPV2 may be about 2H, but is not limited thereto.

Each of the plurality of output enable signals OE1 and OE2 includes a pulse synchronized with a corresponding gate clock signal CPV1 and CPV2. For example, a first output enable signal OE1 includes a pulse corresponding to a low period between two adjacent pulses of the first gate clock signal CPV1, and a second output enable signal OE2 includes a pulse corresponding to a low period between two adjacent pulses of the second gate clock signal CPV2. Here, a pulse width of each output enable signal OE1 and OE2 may be identical to or greater than a width of the low period of the corresponding gate clock signal CPV1 and CPV2. A period of a pulse of each output enable signal OE1 and OE2 may be about 2H, but is not limited thereto.

Referring to FIG. 8, the gate lines driver 400 is synchronized with a gate clock signal CPV1 and CPV2 and sequentially outputs gate signal Vg1, Vg2, Vg3, . . . . Specifically, the first gate signal Vg1 may include a period when it is the gate-on voltage Von synchronized with each pulse of the first gate clock signal CPV1, that is, a pre-charging period P1 and a main charging period P2. The second gate signal Vg2 followed by the first gate signal Vg1 may include a period when it is the gate-on voltage Von synchronized with the second gate clock signal CPV2, that is, the pre-charging period P1 and the main charging period P2. A third gate signal Vg3 (shown in FIG. 8) followed by the second gate signal Vg2 may include a gate-on voltage Von period synchronized with the first gate clock signal CPV1, that is, the pre-charging period P1 and the main charging period P2.

As described above and illustrated in FIG. 5, a low voltage period of each gate signal Vg1, Vg2, . . . includes a gate-off voltage Voff, and a high voltage period thereof includes the pre-charging period P1, the main charging period P2, and an intermediate period P3 positioned between pre-charging period P1 and the main charging period P2.

In the pre-charging period P1 and the main charging period P2, each gate signal Vg1, Vg2, . . . has a level of the full gate-on voltage Von. In the intermediate period P3, each gate signal Vg1, Vg2, . . . has a level of a predetermined voltage Va between the full gate-on voltage Von and the gate-off voltage Voff. The predetermined voltage Va may be an approximate average voltage of the gate-on voltage Von and the gate-off voltage Voff.

As illustrated in FIG. 8, the intermediate period P3 of each gate signal Vg1, Vg2, Vg3, . . . is synchronized with a corresponding output enable signal OE1 and OE2, and has a width approximately identical to a width of a corresponding pulse of the output enable signal OE1 and OE2. For example, the intermediate period P3 of the first gate signal Vg1 is synchronized with a pulse of the first output enable signal OE1 and has a width approximately identical to a width of the corresponding pulse of the first output enable signal OE1. Also, the intermediate period P3 of the second gate signal Vg2 is synchronized with a pulse of the second output enable signal OE2 and has a width approximately identical to a width of the corresponding pulse of the second output enable signal OE2. The intermediate period P3 of the third gate signal Vg3 is synchronized with a subsequent pulse of the first output enable signal OE1 and has a width approximately identical to a width of the corresponding pulse of the first output enable signal OE1. (Accordingly, if row inversion or dot polarity inversion is being employed, the P2 phase of Vg1 is synchronized with the P1 phase of Vg3 where the respective switching elements of each are being driven by data voltage of a same polarity. On the other hand, the resistive bleed phase P3 of Vg2 has (in one embodiment) its respective switching element being driven by data voltage of an opposite polarity. As a result, pre-charging of the appropriate polarity takes place despite the use of dot or row inversion.)

The gate lines driver 400 sequentially applies a gate-on voltage Von of a gate signal Vg1, Vg2, . . . to a gate line G1-Gn and thereby turns on a switching element Q connected to the gate line G1-Gn. Next, a data voltage Vd applied to the data line D1-Dm is applied to a corresponding pixel PX through the turned-on switching element Q.

As described above, in the case of driving a display device based on a driving signal according to the exemplary embodiment of FIG. 8, when the gate-on voltage Von of the main charging period P2 is applied to the i-th gate line Gi and thereby the pixel PX connected thereto is mainly charged with the target data voltage, the gate signal Vgi to be applied to the i-th gate line Gi is already elevated to a voltage of an intermediate level between the gate-on voltage Von and the gate-off voltage Voff, not to the gate-off voltage Voff, immediately before the gate-on voltage Von of the main charging period P2 is applied and thus, may quickly reach the full gate-on voltage Von in the main charging period P2. Accordingly, in the main charging period P2, the corresponding pixel PX may be sufficiently charged with the target data voltage and thus, a charging rate of the pixel PX may be increased.

Hereinafter, an example of the level shifter 420 of the gate lines driver according to an exemplary embodiment of the present disclosure applicable to the driving method of FIG. 8 will be described with reference to FIGS. 8 and 9.

Figure 9:
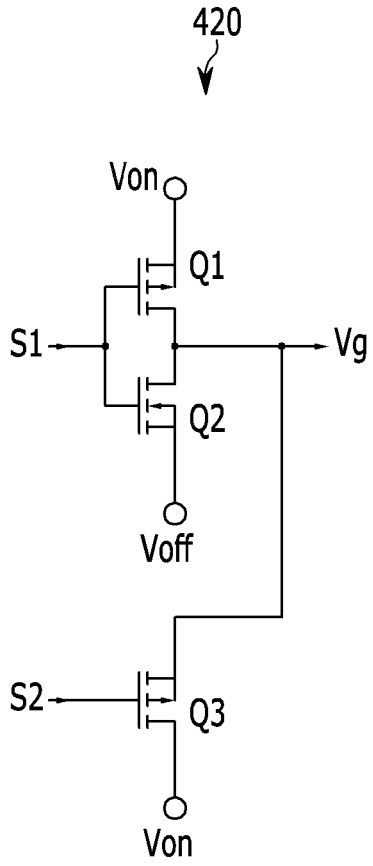
FIG. 9 is an example of a circuit diagram of a level shifter of a gate lines driver according to an exemplary embodiment.

FIG. 9 is an example of a circuit diagram of another level shifter stage usable in the gate lines driver according to an exemplary embodiment of the present disclosure.

Referring to FIG. 9, the level shifter 420 of the gate lines driver 400 according to an exemplary embodiment includes a first transistor Q1 connected between a gate-on voltage Von and an output terminal of a gate voltage Vg, a second transistor Q2 connected between a gate-off voltage Voff and the output terminal, and a third transistor Q3 connected between the gate-on voltage Von and the output terminal. The first to third transistors Q1, Q2, and Q3 may be MOSFETs.

A channel type of the first transistor Q1 may be identical to a channel type of the third transistor Q3, and a channel type of the second transistor Q2 may be different from the channel type of the first and third transistors Q1 and Q3. For example, according to the exemplary embodiment of FIG. 9, the channel types of the first transistor Q1 and the third transistor Q3 may be a P type, and the channel type of the second transistor Q2 may be an N type. However, a channel type of a transistor is not limited thereto and channel types of the first to third transistors Q1, Q2, and Q3 may be changed to be opposite to the channel types illustrated in FIG. 9.

The first transistor Q1 and the second transistor Q2 are controlled by an identical first control signal S1, and the third transistor Q3 is controlled by a second control signal S2 separate from the first control signal S1. The first control signal S1 is simultaneously applied to a gate of the first transistor Q1 and a gate of the second transistor Q2, and the second control signal S2 is applied to a gate of the third transistor Q3. The first control signal S1 is a control signal synchronized with an inversion of the gate clock signal CPV1 and CPV2, and the second control signal S2 is a control signal synchronized with an inversion of the output enable signal OE1 and OE2. For example, in the present exemplary embodiment, the first control signal S1 may have a low voltage when the gate clock signal CPV1 and CPV2 has a high level, and may have a high voltage when the gate clock signal CPV1 and CPV2 has a low level. The second control signal S2 may have a low voltage when the output enable signal OE1 and OE2 has a high level, and may have a high voltage when the output enable signal OE1 and OE2 has a low level.

Hereinafter, an operation of the level shifter 420 constructed above will be described with reference to FIGS. 8 and 9.

Initially, when the gate clock signal CPV1 and CPV2 reaches a high level in a state in which the output enable signal OE1 and OE2 has a low level, the first transistor Q1 is fully turned on and the second and third transistors Q2 and Q3 are turned off. Accordingly, the full gate-on voltage Von is output through the output terminal and a pre-charging period P1 starts. Here, in the exemplary embodiment of FIG. 9, the first control signal S1 may have a low voltage and the second control signal S2 may have a high voltage.

Next, when the gate clock signal CPV1 and CPV2 has a low level and the output enable signal OE1 and OE2 reaches a high level, the first transistor Q1 is turned off, the second transistor Q2 is turned on, and the third transistor Q3 is turned on. Accordingly, an intermediate voltage Va between the gate-on voltage Von and the gate-off voltage Voff, that is, a voltage of (Von−Voff)/2 is output through the output terminal and the intermediate period P3 starts. Here, the first control signal S1 may have a high voltage and the second control signal S2 may have a low voltage.

Next, when the gate clock signal CPV1 and CPV2 shifts again from a low level to a high level, the first transistor Q1 is fully turned on and the second transistor Q2 is turned off. Accordingly, the full gate-on voltage Von is output through the output terminal and the main charging period P2 starts. Here, the output enable signal OE1 and OE2 may reach a low level and the third transistor Q3 may be turned off. Here, the first control signal S1 may have a low voltage and the second control signal S2 may have a high voltage.

While this disclosure of invention has been described in connection with what is presently considered to be practical exemplary embodiments, it is to be understood that the present teachings are not limited to the disclosed embodiments, but, on the contrary, the present disclosure is intended to cover various modifications and equivalent arrangements included within the spirit and scope of the present teachings.

What is claimed is:

1. A driving method which drives a display device having a display panel comprising a plurality of gate lines and having a gate lines driver configured to output respective gate signals to the plurality of gate lines respectively, the method comprising:

receiving, by the gate lines driver, at least one gate clock signal and at least one output enable signal, the output enable signal having a first level representing a first digital state and a second level representing a second digital state;

outputting, by the gate lines driver, a first gate line driving voltage or a second gate line driving voltage different from the first gate line driving voltage when the at least one output enable signal is at the first level; and outputting, by the gate lines driver, a third gate line driving voltage having a level between that of the first and second gate line driving voltages when the at least one output enable signal is at the second level, wherein:

the gate lines driver includes a level shifter and the level shifter comprises:

a first transistor and a second transistor that are both controlled by a first control signal, and a third transistor that is controlled by a second control signal separate from the first control signal, wherein the first control signal is synchronized with the at least one gate clock signal, and the second control signal is synchronized with the at least one output enable signal.

2. The method of claim 1, wherein:

the first gate line driving voltage includes a transistor-saturating gate-on voltage, and the second gate line driving voltage includes a gate-off voltage.

3. The method of claim 2, wherein:

the third gate line driving voltage is at least approximately equal to an average of the gate-on voltage and of the gate-off voltage.

4. The method of claim 3, wherein:

the first transistor is connected between the gate-on voltage and an output terminal providing the first, second and third gate line driving voltages, and the second transistor is connected between the gate-off voltage and the output terminal.

5. The method of claim 4, wherein:

a channel type of the first transistor is opposite to a channel type of the second transistor, and a channel type of the third transistor is identical to the channel type of the second transistor.

6. The method of claim 5, wherein:

the third transistor is connected between the output terminal and the gate-off voltage.

7. The method of claim 6, wherein:

the outputting of the first gate line driving voltage or the second gate line driving voltage when the output enable signal is the first level comprises outputting the gate-on voltage during a pre-charging period immediately before a period when the output enable signal is the second level and also outputting the gate-on voltage during a main charging period immediately after the period when the output enable signal is the second level.

8. The method of claim 4, wherein:

a channel type of the first transistor is opposite to a channel type of the second transistor, and a channel type of the third transistor is identical to the channel type of the first transistor.

9. The method of claim 8, wherein:

the third transistor is connected between the output terminal and the gate-on voltage.

10. The method of claim 9, wherein:

the outputting of the first gate line driving voltage or the second gate line driving voltage when the output enable signal is the first level comprises outputting the gate-on voltage during a pre-charging period immediately before a period when the output enable signal is the second level and also outputting the gate-on voltage during a main charging period immediately after the period when the output enable signal is the second level.

11. A display device, comprising:

a display panel comprising a plurality of gate lines; and a gate lines driver configured to receive a gate clock signal and an output enable signal, the output enable signal having a first level and a second level, the gate lines driver being further configured to output respective gate line driving signals to respective ones of the plurality of gate lines, wherein the gate lines driver comprises a level shifter configured to output a first gate line driving voltage or a second gate line driving voltage different from the first gate line driving voltage when the output enable signal is the first level, and to output a third gate line driving voltage having a level between those of the first and second gate line driving voltages when the output enable signal is the second level, wherein:

the first gate line driving voltage includes a gate-on voltage, the second gate line driving voltage includes a gate-off voltage the level shifter comprises a first transistor and a second transistor that are controlled by a first control signal, and a third transistor that is controlled by a second control signal separate from the first control signal, the first control signal is synchronized with the gate clock signal, the second control signal is synchronized with the output enable signal, the first transistor is connected between the gate-on voltage and an output terminal which outputs the first, second and third gate line driving voltages, and the second transistor is connected between the gate-off voltage and the output terminal.

12. The display device of claim 11, wherein:

the third gate line driving voltage is an average of the gate-on voltage and the gate-off voltage.

13. The display device of claim 11, wherein:

a channel type of the first transistor is opposite to a channel type of the second transistor, a channel type of the third transistor is identical to the channel type of the second transistor, and the third transistor is connected between the output terminal and the gate-off voltage.

14. The display device of claim 13, wherein:

the gate lines driver outputs to a respective one of the plurality of gate lines, the gate-on voltage during a pre-charging period immediately before a period when the output enable signal is the second level and also outputs the gate-on voltage to the respective gate line during a main charging period which occurs immediately after the period when the output enable signal is the second level.

15. The display device of claim 14, wherein: the display panel further comprises:

a first data line and a second data line extended in a first direction and adjacent to each other; and a plurality of pixels connected to the first and second data lines and the plurality of gate lines, and a plurality of pixels arranged in the first direction are alternately connected to the first and second data lines.

16. The display device of claim 11, wherein:

a channel type of the first transistor is opposite to a channel type of the second transistor, a channel type of the third transistor is identical to the channel type of the first transistor, and the third transistor is connected between the output terminal and the gate-on voltage.

17. The display device of claim 16, wherein:

the gate lines driver outputs the gate-on voltage during a pre-charging period immediately before a period when the output enable signal is the second level and also outputs the gate-on voltage during a main charging period immediately after the period when the output enable signal is the second level.

18. The display device of claim 17, wherein:

the display panel further comprises:

a first data line and a second data line extended in a first direction and adjacent to each other; and a plurality of pixels connected to the first and second data lines and the plurality of gate lines, and a plurality of pixels arranged in the first direction are alternately connected to the first and second data lines.

* * * * *